US008517556B2

(12) United States Patent
Boulan

(10) Patent No.: US 8,517,556 B2
(45) **Date of Patent: *Aug. 27, 2013**

(54) HELMET MOUNTED LIGHTING APPARATUS AND METHOD OF MANUFACTURE

(76) Inventor: Christian Boulan, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/462,769

(22) Filed: May 2, 2012

(65) Prior Publication Data

US 2012/0243211 A1 Sep. 27, 2012

Related U.S. Application Data

(63) Continuation of application No. 12/104,388, filed on Apr. 16, 2008, now Pat. No. 8,177,384.

(60) Provisional application No. 60/912,390, filed on Apr. 17, 2007.

(51) Int. Cl.
*F21V 21/084* (2006.01)

(52) U.S. Cl.
USPC ..... 362/105; 362/800; 362/570; 2/5

(58) Field of Classification Search
USPC ..... 362/105, 106, 570, 572; 2/5, 422
See application file for complete search history.

(56) References Cited

U.S. PATENT DOCUMENTS

| | | | |
|---|---|---|---|
| 5,357,409 | A | 10/1994 | Glatt |
| 5,408,393 | A | 4/1995 | Becker |
| 5,544,027 | A | 8/1996 | Orsano |
| 5,564,128 | A | 10/1996 | Richardson |
| 5,570,946 | A | 11/1996 | Chien |
| 5,845,987 | A | 12/1998 | Painter |
| 6,116,745 | A | 9/2000 | Yei |
| 6,955,444 | B2 | 10/2005 | Gupta |
| 7,210,810 | B1 | 5/2007 | Iversen et al. |
| 7,234,831 | B1 | 6/2007 | Hanley |
| 7,242,383 | B2 | 7/2007 | Zavracky et al. |
| 7,784,960 | B2 | 8/2010 | Lahtinen |
| 7,845,816 | B2 | 12/2010 | Lombard et al. |
| 2006/0133069 | A1 | 6/2006 | Clupper et al. |
| 2007/0217184 | A1 | 9/2007 | Berry |
| 2008/0080170 | A1 | 4/2008 | Lombard |

OTHER PUBLICATIONS

Spartan Shield Light product description, Shining Bright on Safety. 2 pages.

*Primary Examiner* — Jong-Suk (James) Lee
*Assistant Examiner* — Leah S Macchiarolo
(74) *Attorney, Agent, or Firm* — ARC IP Law, PC; Joseph J. Mayo

(57) ABSTRACT

Helmet mounted lighting apparatus and method of manufacture. May utilize LED light source and battery power unit designed for mounting for example on a fire-fighting helmet. May couple with helmet or to an ornamental leather shield typically mounted on the front of a fire-fighting helmet. Enables enhanced visual field at night for benefit of the user. Apparatus is made of material suitable for the harsh conditions encountered by fire suppression and emergency personnel and is mounted in such a fashion as to not conflict with the typical physical features of the helmet or shield. The apparatus includes at least one lamp provided at a front side of the casing, a switch part provided remote to or in one side of the casing, a battery or series of batteries provided remotely or in the interior of the casing and optional time-out, power level adjustment, voltage and/or current control circuitry.

20 Claims, 8 Drawing Sheets

HELMET MOUNTED LIGHTING APPARATUS AND METHOD OF MANUFACTURE

This application is a continuation of U.S. Utility patent Ser. No. 12/104,388, filed 16 Apr. 2008, now U.S. Pat. No. 8,177,384, which claims the benefit of U.S. Provisional Patent Application Ser. No. 60/912,390 filed 17 Apr. 2007, the specifications of which are hereby incorporated herein by reference.

BACKGROUND OF THE INVENTION

1. Field of the Invention

Embodiments of the invention described herein pertain to the field of lighting. More particularly, but not by way of limitation, one or more embodiments of the invention enable a helmet mounted lighting apparatus and method of manufacture.

2. Description of the Related Art

Lighting apparatus such as a flashlight or headlight with head strap provide portable lighting. These apparatus use halogen, standard filament, neon and light emitting diodes (LEDs) to emit light. Various methods of powering portable lights include cylinder, coin, button, disposable and rechargeable batteries.

Currently known portable lighting apparatus are generally bulky and difficult to control, i.e., turn on or off in certain environments or situations. For example, attempting to operate a small light switch with gloves on in an environment that requires gloves is difficult. Hand held lights require use of one hand to hold the light, which is unacceptable to users that require both hands to be free.

Mining lanterns and headlamps are bulky and/or protrude from a mining helmet for example. These types of lights provide underground portable lighting for miners. The headlamps catch on objects in the environment and are not easy to operate.

For at least the limitations described above there is a need for a helmet mounted lighting apparatus and method of manufacture.

BRIEF SUMMARY OF THE INVENTION

One or more embodiments of the invention enable a helmet mounted lighting apparatus and method of manufacture. For example, by coupling the apparatus with a helmet or fire shield, the apparatus may be worn on a fire helmet. In this embodiment, the apparatus is manufactured to conform to the helmet shape and optionally couple to the inside of the helmet or to a fire shield worn on the outside of the helmet. By coupling the apparatus to a helmet, the apparatus does not interfere with the operation of goggles for example. In addition, by utilizing a touch based switch, the apparatus may be operated, i.e., turned on or off without removing one's gloves. Use of lights such as light emitting diodes (LEDs) allows for longer use without replacing batteries. Furthermore, LED lights are shock resistant and allow for rugged deployment to a variety of environments that promote short life for filament-based lights. Time-out circuitry may be utilized to turn the light off after a specified amount of time to avoid accidental battery drain. Preventing accidental battery drain provides a more robust apparatus that remains operational longer between battery replacement.

In embodiments of the invention that utilize at least one LED, the LED is typically in the form of a LED bulb. The LED bulb uses a glass lens capsule to direct light to the rounded tip of the capsule. This bending of light causes a narrow high intensity focus at the tip and a diverging beam emanating from the tip. The LED(s) is/are adapted to emit light in at least one direction.

An activation button is utilized for activation of the LED. The button may include a push button or pressure sensor that allows for easy operation without requiring a small switch to be activated for example.

A power source is coupled with the LED(s) and is configured as a slender design for unobstructed mounting. One embodiment of the power source is a battery housing. A battery housing contains a battery or series of batteries attached at one end thereof to the lights e.g., LEDs or series of LEDs. Slender coin style batteries, like the ENERGIZER® 2016 and 2032 type batteries may be utilized in one or more embodiments to provide power to the LED(s) either through direct electrical contact or wiring. In other embodiments of the invention, AAA, AA or any other cylindrical type battery may also be utilized. Wiring may provide further latitude in customization.

Circuitry may be utilized along with the standard features of the apparatus. Since accidental activation and subsequent drain of unit power source can be problematic, the apparatus may include circuitry that powers down the light after a configurable or specified amount of time.

Features provided by the apparatus make the invention ideal for use in the fire service as service lights on fire helmet shields or similar fields. Functionality of fire shields has been limited to numbering and lettering for identification purposes and many have maintained a purely ornamental aspect to their use. The combination of the LED unit and fire shield brings a new level of functionality to the shield not previously known.

Safety helmets are increasingly used in work applications. Many applications require means of identification or desire decorative additions to the helmets. The fire service uses slender, pliable shields, typically made of leather, that serve as both decoration and identification. Fire shields are used on virtually every safety helmet in service at fire departments within the United States. The LED assembly may be used as a medallion type assembly for mounting on identification or decorative shields, as found in the fire service, or mounted directly within the shield or helmet.

Potential uses and markets are not limited to the fire service industry or markets using helmet shields. The ability of the apparatus to operate in harsh environments and the low-profile mounting enables the invention to provide usefulness in a variety of fields that require dependable lighting. Cave exploring, camping, interior lighting are additional fields where this product may be utilized for example.

Approved specialty gels, silicones and sealant strips may be utilized for sealing the housing from the harsh environment. A PCB assembly is an inexpensive means on constructing multiple units. In circumstances where exterior wiring is required, temperature resistant wiring provides further product ruggedness and robust operation in dangerous environments.

One or more embodiments of the invention may be manufactured by coupling an LED to a power source and touch switch and further coupling the apparatus to a helmet or shield configured to be mounted on a helmet.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

A helmet mounted lighting apparatus and method of manufacture will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
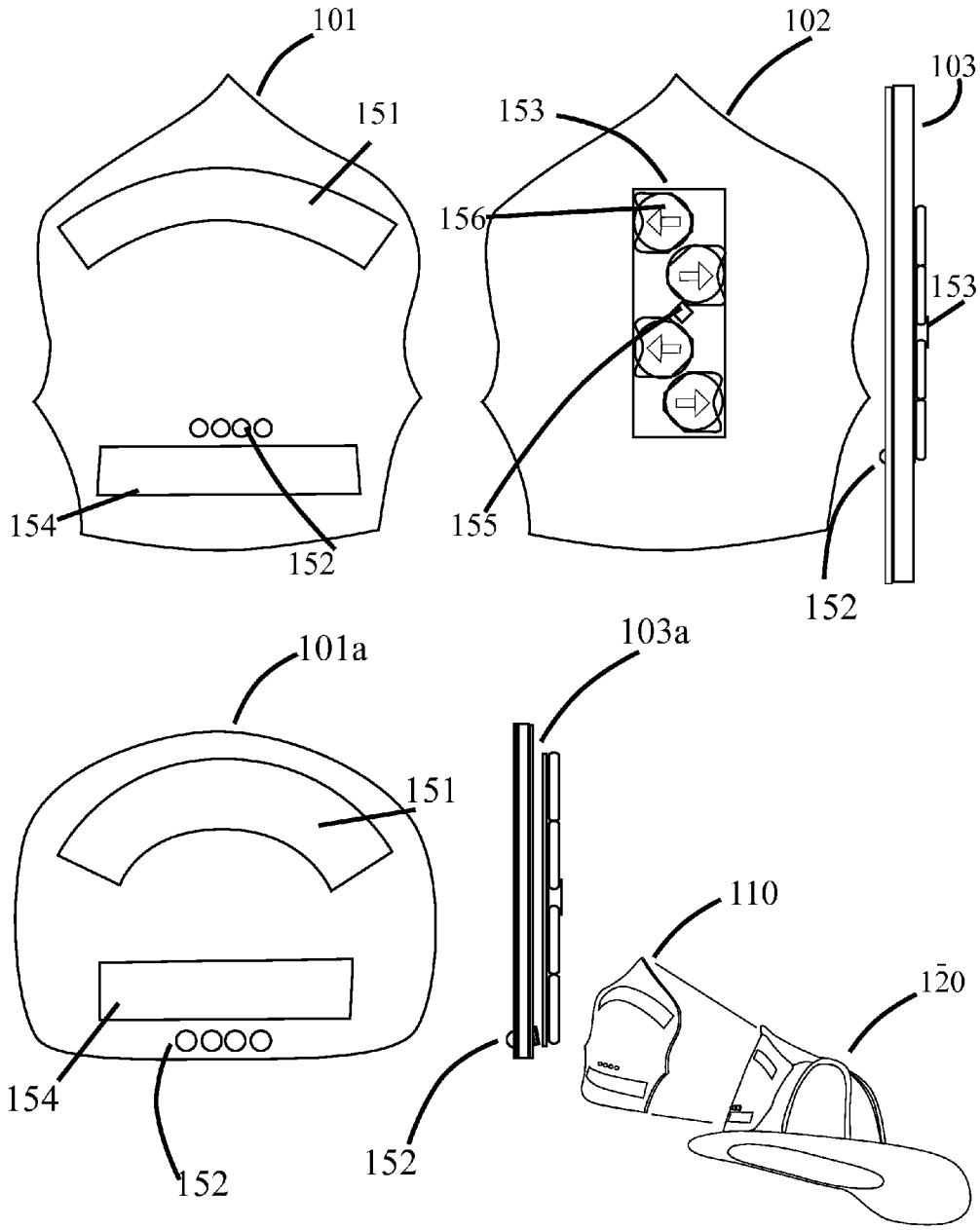
FIG. 1 shows front, back and side views of one embodiment and front and side views of a second embodiment and in addition shows helmet mounting.

FIG. 1 shows front, back and side views 101, 102 and 103 respectively of one embodiment and front and side views 101*a* and 103*a* of a second embodiment. In addition, FIG. 1 shows helmet mounting of shield 110 on helmet 120. Any type of coupling element may be utilized in mounting lighting apparatus 153 to shield 110 including but not limited to hook and loop material, sewn material, threaded screws or adhesive. Front view 101 of shield 110 shows name areas 151 and 154 for applying text for example. LEDs 152 extend from the rear of shield 110 to the front so that light may emit from shield 110. LEDs 152 are activated in this embodiment by pressing on the front of shield 110 that activates switch 155. Any type of switch may be utilized including a push-button switch (latching or non-latching) or toggle switch. A push-button switch of the non-latching type may include a latching circuit to keep the light on after the finger is taken off of the switch or button coupled with the switch. Use of a short throw switch allows for mounting the switch behind the shield. If the switch utilized has a longer throw, then a hole may be drilled into the shield that allows for the switch to be accessed. Hence, the switch may protrude through the shield or be situated behind the shield in keeping with the spirit of the invention. In other embodiments, the switch may be mounted remotely as will be described below. In one or more embodiments of the invention, lighting apparatus 153 includes a PCB board. LEDs 152 are powered by power source 153, in this case a battery although fuel cells or any other type of power source may be utilized. These are shown in back view 102. Side view 103 shows the thickness of this embodiment that allows for mounting between the shield and a helmet for example.

A second embodiment is shown coupled with the shield shown in front view 101*a*. Side view 103*a* shows a thickness that may be greater than the thickness shown in side view 103 to accommodate more power source elements in depending on the application, i.e., shield size and helmet size and/or curvature for example.

Figure 2:
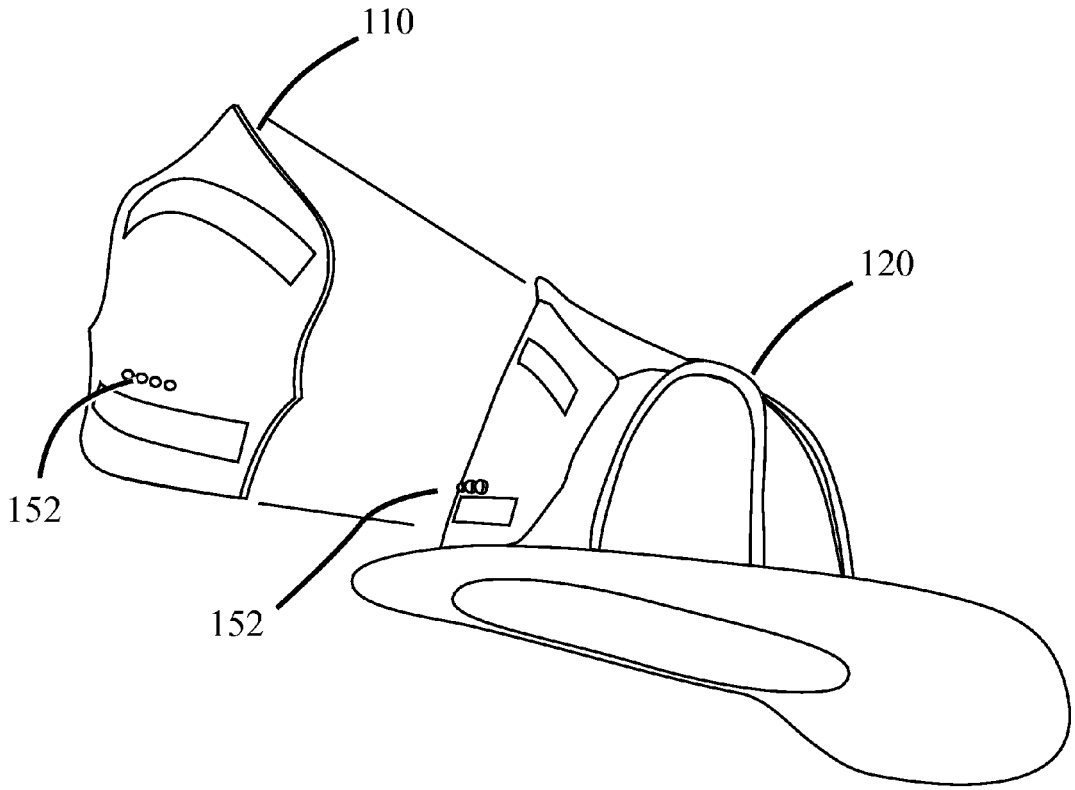
FIG. 2 shows a close up of the helmet mounting of FIG. 1.

FIG. 2 shows a close up of helmet 120 mounting with shield 110 of FIG. 1. With LEDs 152 coupled with shield 110, helmet 120 thus is coupled with LEDs 152 when shield 110 is coupled with helmet 120. In other embodiments of the invention, lighting apparatus 153 may be mounted inside helmet 120 for example with a painted shield on the front of helmet 120. Any ornamental covering placed in front of lighting apparatus 153 that is coupled with a helmet is in keeping with the spirit of the invention.

Figure 3:
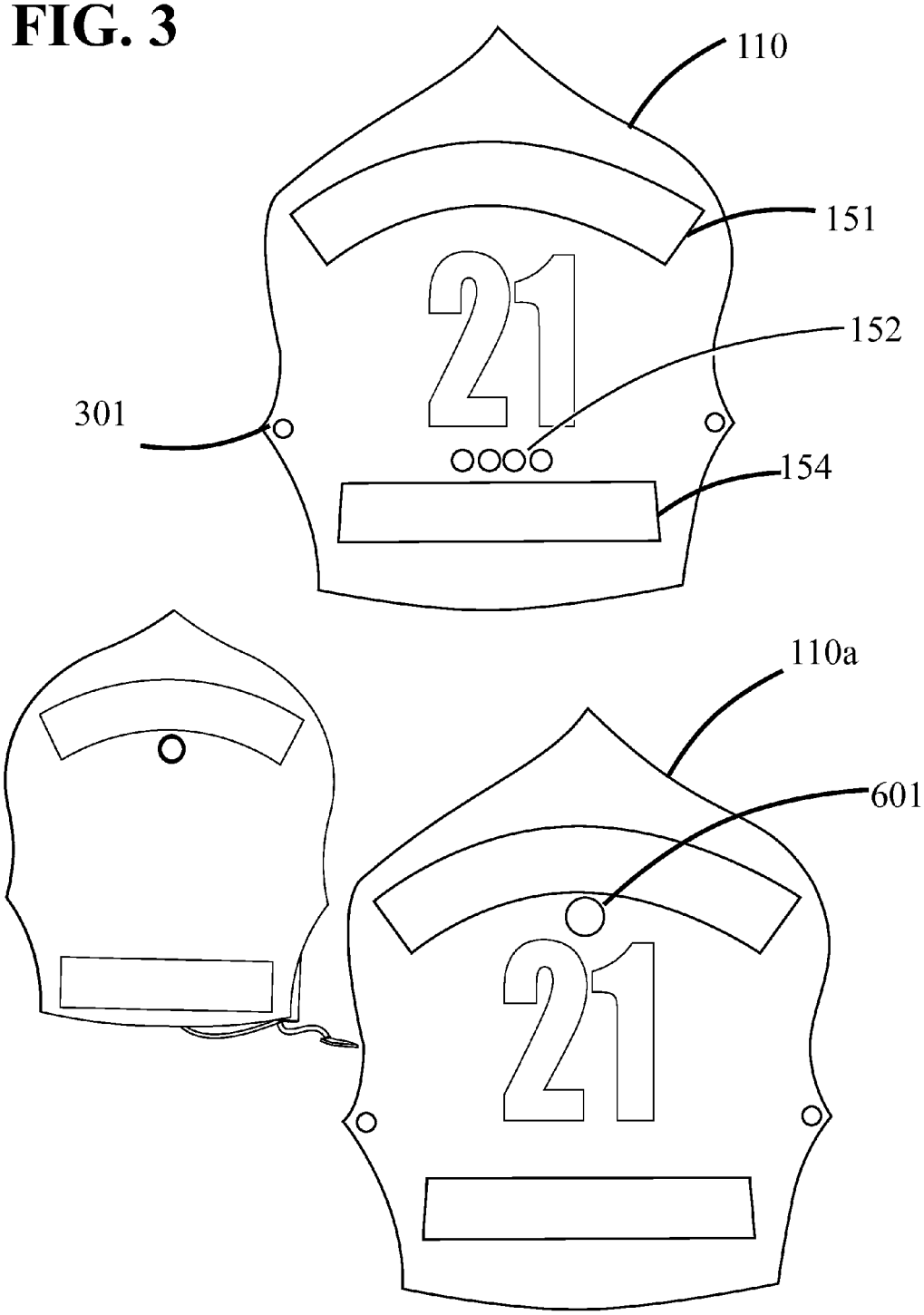
FIG. 3 shows an embodiment coupled with a shield.

FIG. 3 shows an embodiment coupled with shield 110. In this figure, LEDs 152 can be seen at the center of shield 110 that is activated by pressing the center of the shield (where the large number "21" appears). Coupling hole 301 is but one type of connection object that may be utilized in coupling shield 110 with a helmet. Types of connectors that may be utilized in coupling shield 110 to a helmet include but are not limited to hook and loop material, sewn material, threaded screws or adhesive. In addition, FIG. 3 also shows another embodiment of shield, namely shield 110*a*. In this embodiment, light 601 is mounted without use of a PCB board and hence termed the "remote" embodiment since the power source and switch may be mounted remotely with respect to light 601. Light 601 may include an LED and optic or reflector to spread the light over any desired angle.

Figure 4:
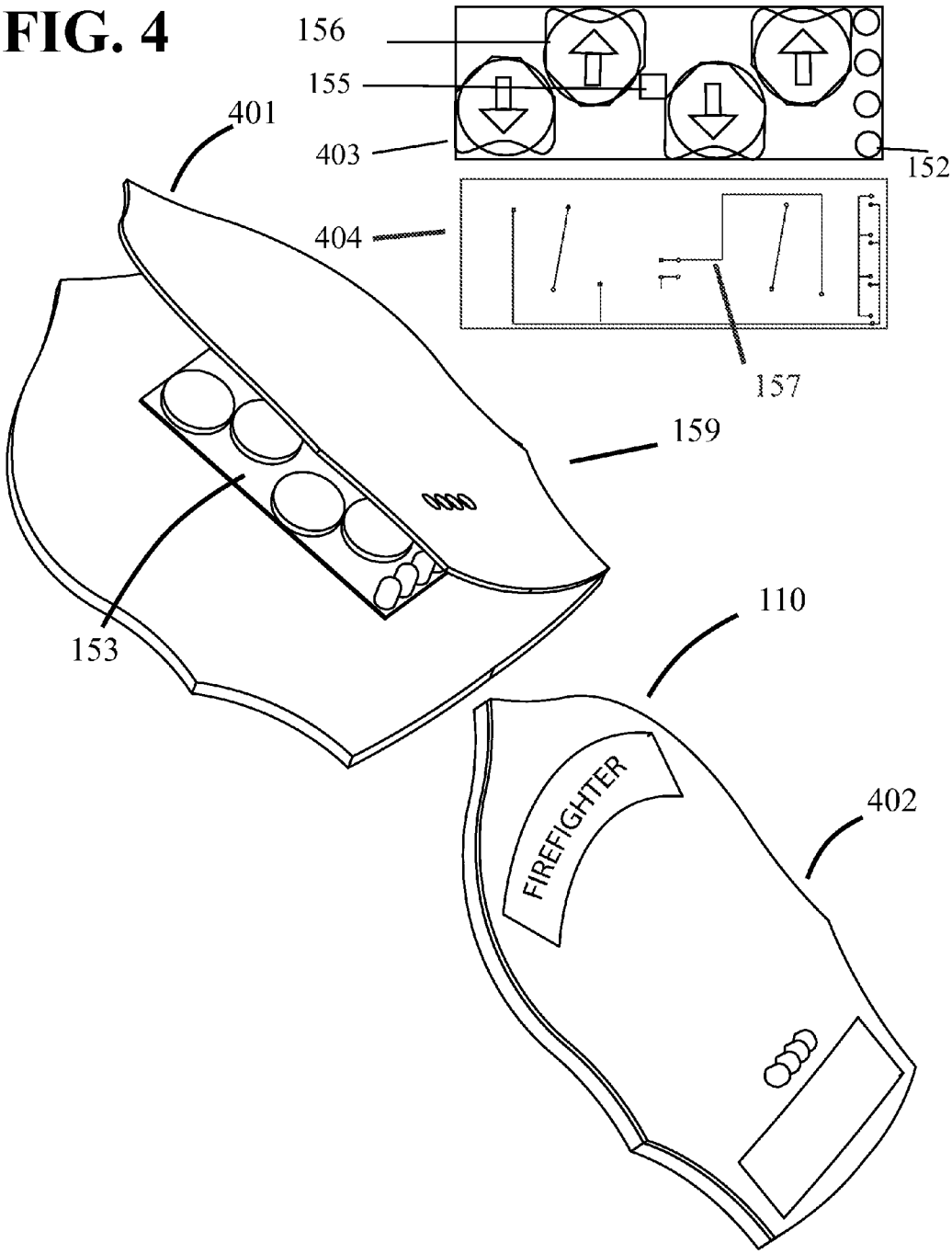
FIG. 4 shows an embodiment mounted behind a shield and a top and bottom view of a circuit configured to couple a power source to a switch to at least one light.

FIG. 4 shows an embodiment mounted behind shield 110 and top and bottom views 403 and 404 respectively of a circuit configured to couple power sources 156 to switch 155 to at least one light 152. Lighting apparatus 153 is shown on back view 401 of a shield with protective covering 159 peeled back. Front view 402 shows shield 110 in the forward orientation. Back view 403 of the apparatus shows power sources 156 and switch 155 while rear view 404 shows lines 157 connecting each power source to one another. In one or more embodiments of the invention, the batteries are connected in parallel, although the power sources may also be connected in series depending on the voltages of the LEDs in relation to the voltages of the batteries.

Figure 5:
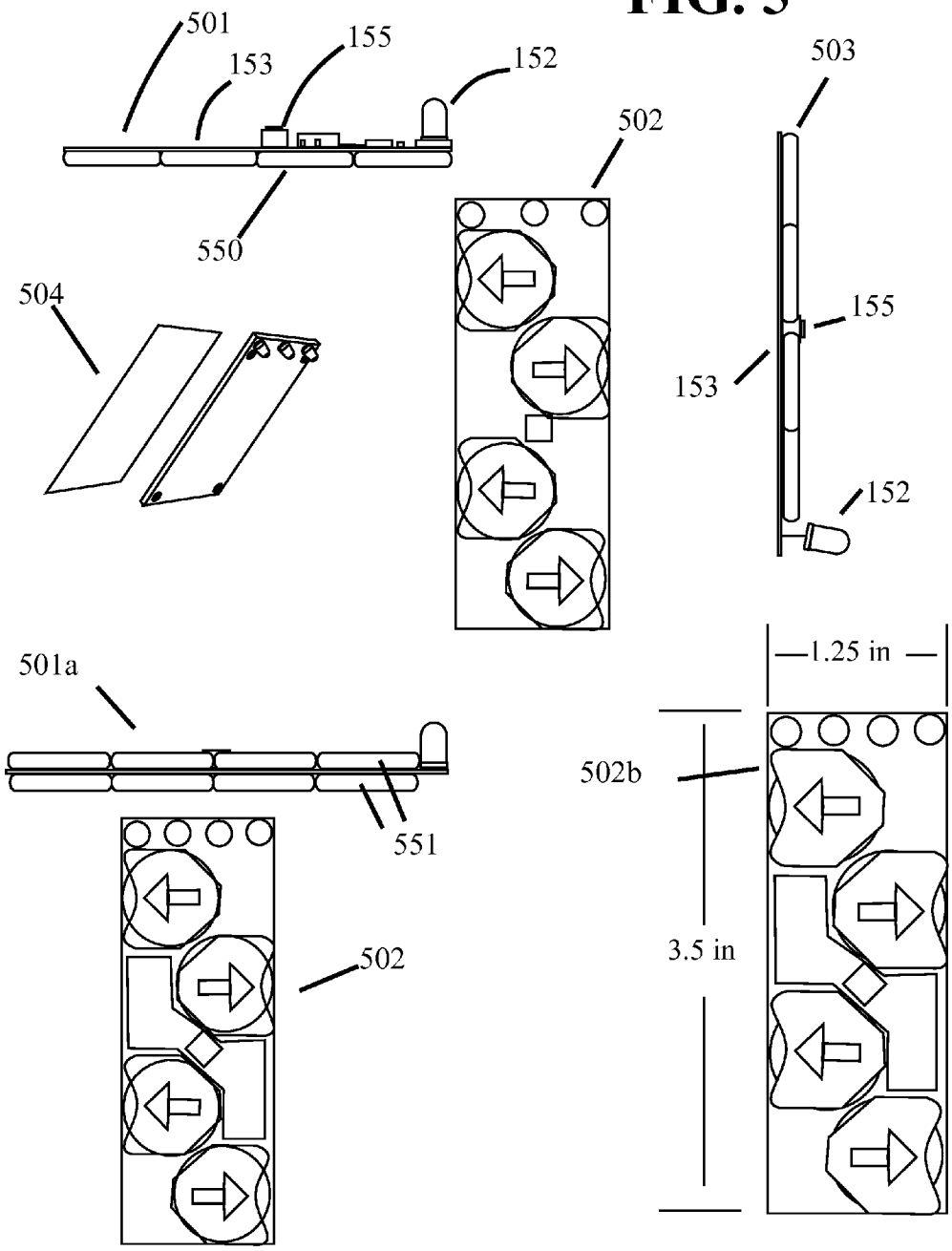
FIG. 5 shows two embodiments of the invention, one with power source elements on one side and the other with power source elements on both sides of the apparatus.

FIG. 5 shows two embodiments of the invention 501 and 501*a*, one with power source elements on one side and the other with power source elements on both sides of the apparatus. Lighting apparatus side view 501 is shown with power sources 550 only on the rear side of the apparatus while lighting apparatus side view 501*a* is shown with power sources 551 on both sides of the apparatus for increased power. Other embodiments of the invention may utilize remote battery housings that may reside away from the shield to increase the amount of battery reserve available to the lights as well be described below. Rear views 502 and 502*a* show the power sources, while front view 502*b* also shows the power sources. Side view 503 also shows an embodiment with lights 152 pointed down at 10 degrees. Any other angle of orienting lights 152 is in keeping with the spirit of the invention.

Figure 6:
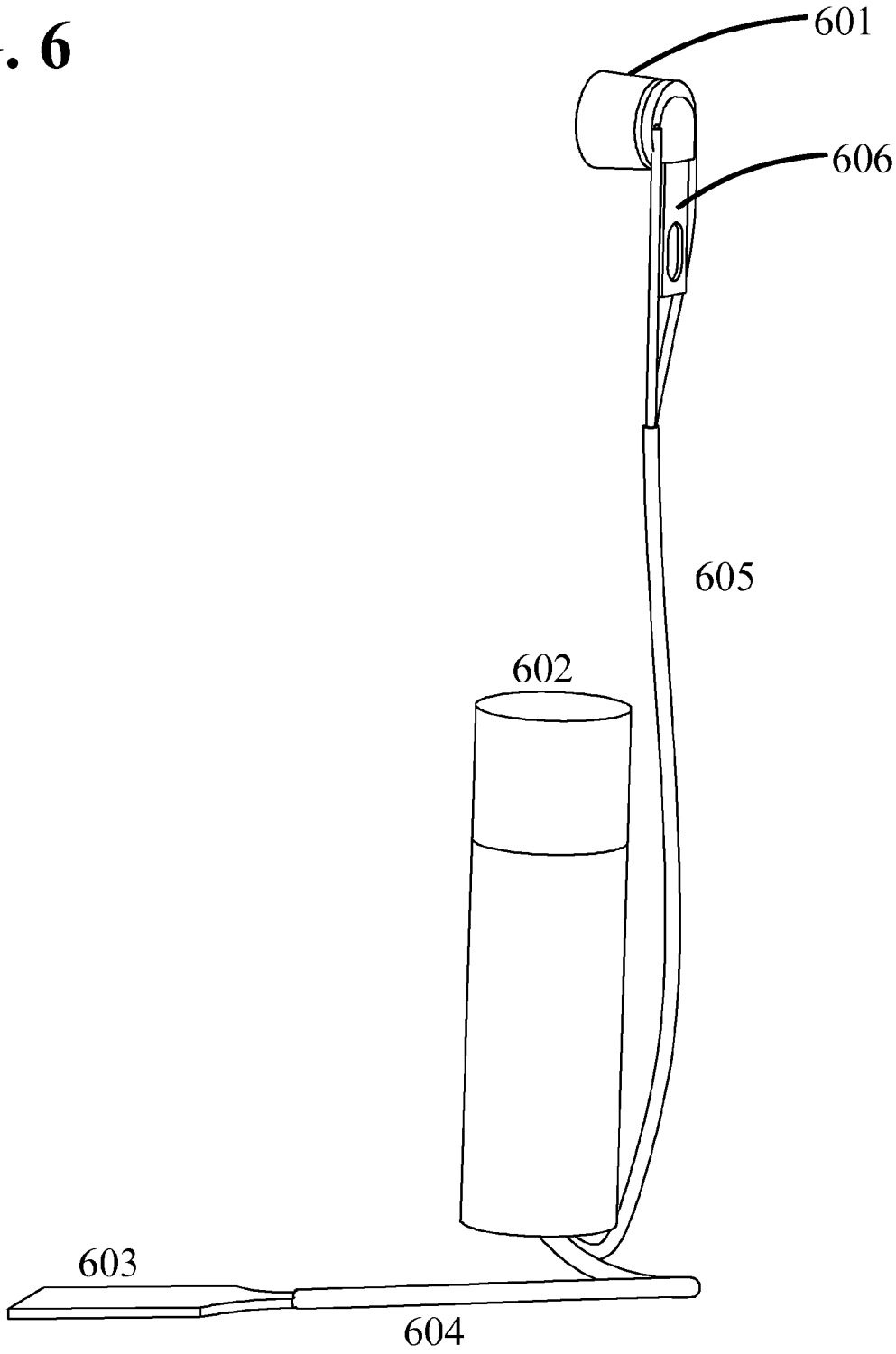
FIG. 6 shows the embodiment of the light apparatus known as the "remote" embodiment.

FIG. 6 shows the embodiment of the light apparatus known as the "remote" embodiment. In this figure, light 601 is coupled to mounting unit 606 that is coupled with shield 110*a*. Alternatively, mounting unit 606 may couple with helmet 120 in one or more embodiments. Light 601 obtains power from power source 602 via wire 605. Switch 603 couples with power source 602 via wire 604. Power source 602 may include an external housing, for example a plastic or metal housing configured to hold one or more batteries and any desired circuitry.

Figure 7:
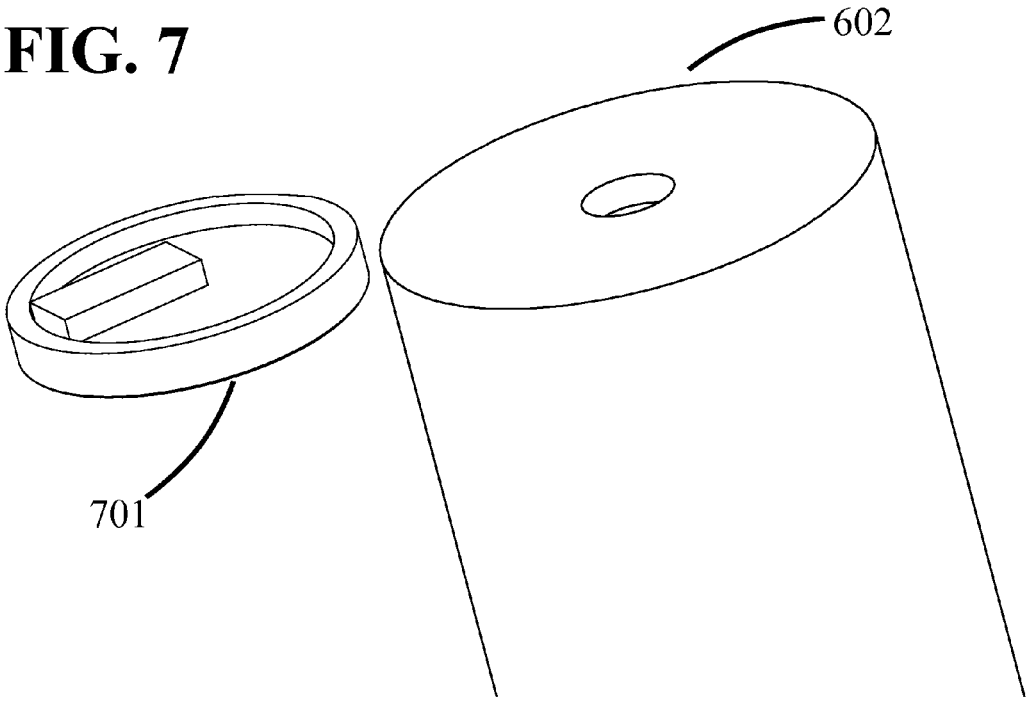
FIG. 7 shows the top of a power source and in addition shows one embodiment of circuitry that may be utilized to control the power source.

FIG. 7 shows the top of power source 602 and in addition shows one embodiment of circuitry 701 that may be utilized to control power source 602. In one or more embodiments, circuitry 701 may be located within a housing associated with power source 602. One embodiment of the invention may utilize a power boost circuit and/or regulator to maintain desired light level from light 601. An example embodiment of circuitry 701 may include a LM2623 boost circuit and PIC 10F200 microcontroller for example. The microcontroller may be programmed to cycle through multiple power levels for example or to toggle power on or off with respect to light 601 or to simply power off after any desired time period.

Figure 8:
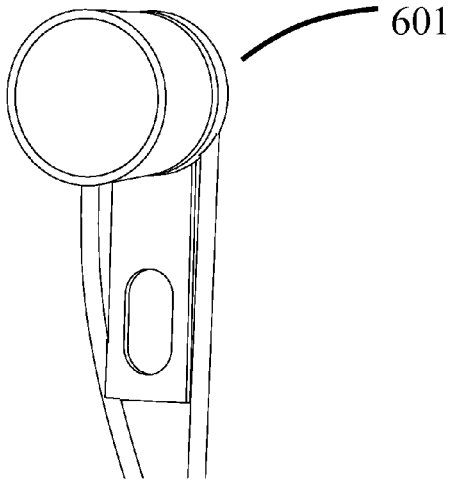
FIG. 8 shows a close up of an embodiment of the light.

FIG. 8 shows a close-up of light 601. An example embodiment of light 601 may include an LED and optional optic, reflector or collimator. Any angle of light emission desired may be selected through utilization of the desired optional optic, reflector or collimator.

Figure 9:
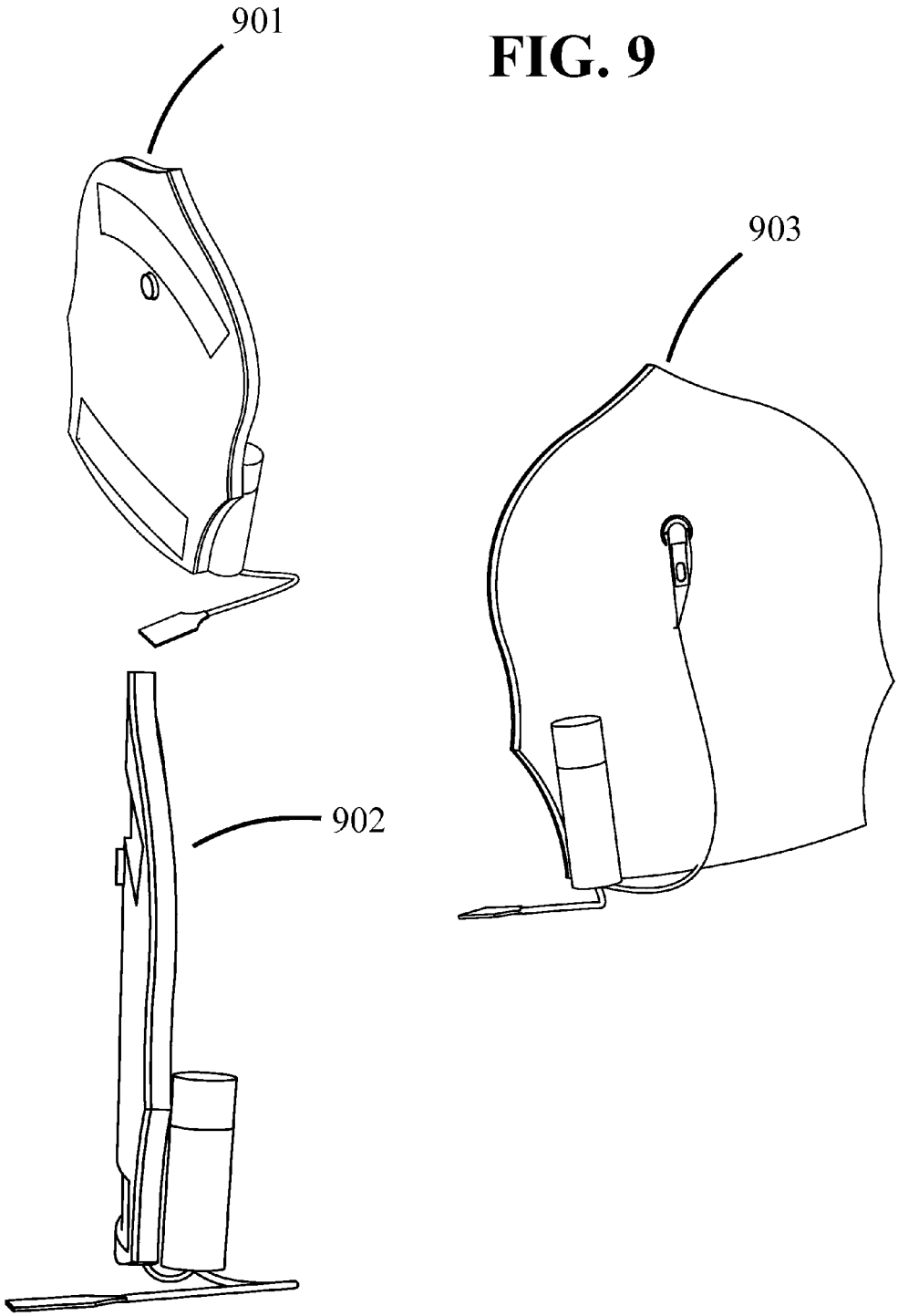
FIG. 9 shows a top perspective view, side view and rear view of the remote embodiment coupled with a shield.

FIG. 9 shows a top perspective view 901, side view 902 and rear view 903 of the remote embodiment coupled with a shield. Also, see FIG. 3 for an alternate embodiment coupled with a shield.

While the invention herein disclosed has been described by means of specific embodiments and applications thereof, numerous modifications and variations could be made thereto by those skilled in the art without departing from the scope of the invention set forth in the claims.

What is claimed is:

1. A helmet mounted lighting apparatus comprising:
an identification or decorative shield removably coupled with a helmet, wherein said identification or decorative shield is conforms to a shape of said helmet;
at least one light;
at least one power source coupled with said at least one light with an electrical connection that does not travel through an outer wall of said helmet to an inner portion of said helmet and wherein said at least one power source does not protrude in front of a main surface area of said identification or decorative shield;
a switch coupled with said at least one power source and at least one light;
said at least one light focused to point forward from said identification or decorative shield wherein said at least one light illuminates an area forward of said helmet;
at least one location on said identification or decorative shield to place said at least one light respectively;
at least one area on said identification or decorative shield wherein said at least one area is configured to receive identification or decorative additions; and,
said switch activates said light when said switch is pressed.

2. The apparatus of claim 1 wherein said at least one light is further configured to point downward at a predefined angle.

3. The apparatus of claim 1 wherein said switch is remote to said at least one power source and wherein said switch is remote to said identification or decorative shield and wherein said switch is configured to remotely activate said light when said switch is pressed.

4. The apparatus of claim 1 wherein said switch is coupled to a rear portion of said identification or decorative shield and wherein said switch is configured to activate said light when a front portion of said identification or decorative shield is pressed that in turn presses said switch.

5. The apparatus of claim 1 wherein said switch is located behind said identification or decorative shield.

6. The apparatus of claim 1 further comprising:
a microcontroller coupled with said power source.

7. The apparatus of claim 1 further comprising:
a microcontroller coupled with said power source wherein said microcontroller is configured to cycle through a plurality of power levels to provide multiple light levels from said at least one light when said switch coupled with said identification or decorative shield is pressed.

8. The apparatus of claim 1 further comprising:
a microcontroller coupled with said power source wherein said microcontroller is configured to turn off said at least one light after a configurable timeout period.

9. The apparatus of claim 1 further comprising:
a boost circuit and microcontroller coupled with said power source.

10. The apparatus of claim 1 further comprising:
a boost circuit and microcontroller coupled with said power source wherein said boost circuit and microcontroller are located in a housing that surrounds said at least one power source.

11. A method of manufacturing a helmet mounted lighting apparatus comprising:
coupling at least one light to at least one power source;
coupling said at least one light to a switch and to said at least one power source with an electrical connection that does not travel through an outer wall of said helmet to an inner portion of a helmet and wherein said at least one power source does not protrude in front of a main surface area of said identification or decorative shield;
conforming an identification or decorative shield to a shape of said helmet;
configuring said identification or decorative shield to removably couple with said helmet;
configuring said identification or decorative shield with at least one location on said identification or decorative shield in which to place said at least one light respectively;
configuring said at least one light to focus said at least one light to point forward from said identification or decorative shield so that said at least one light illuminates an area forward of said helmet;
configuring at least one area on said identification or decorative shield to receive identification or decorative additions;
configuring said switch to activate said at least one light when said switch is pressed.

12. The method of claim 11 further comprising:
configuring said at least one light to point downward at a predefined angle.

13. The method of claim 11 further comprising:
remotely coupling said switch to said identification or decorative shield and said at least one power source and wherein said configuring said switch comprises configuring said switch to remotely activate said at least one light when said switch is pressed.

14. The method of claim 11 further comprising:
coupling said switch to a rear portion of said identification or decorative shield;
configuring said shield to press said switch and activate said light when a front portion of said identification or decorative shield is pressed.

15. The method of claim 11 further comprising:
locating said switch behind said identification or decorative shield.

16. The method of claim 11 further comprising:
coupling a microcontroller to said at least one power source.

17. The method of claim 11 further comprising:

coupling a microcontroller to said at least one power source;

configuring said microcontroller to cycle through a plurality of power levels to provide multiple light levels from said at least one light when said switch coupled with said identification or decorative shield is pressed.

18. The method of claim 11 further comprising:

coupling a microcontroller to said at least one power source;

configuring said microcontroller to turn off said at least one light after a configurable timeout period.

19. The method of claim 11 further comprising:

coupling a boost circuit and a microcontroller to said at least one power source.

20. The method of claim 11 further comprising:

locating a boost circuit and a microcontroller in a housing surrounding said at least one power source.

* * * * *